US006594202B1

(12) United States Patent
Ting

(10) Patent No.: US 6,594,202 B1
(45) Date of Patent: Jul. 15, 2003

(54) TIMEPIECE WITH TIME-DISPLAY AND SKIN-STIMULATION CONTROL CIRCUIT MEANS

(76) Inventor: Wu-Hsiung Ting, No. 65, Lane 30, Lo Li Third Street, An Lo District, Keelung City (TW)

( * ) Notice: Subject to any disclaimer, the term of this patent is extended or adjusted under 35 U.S.C. 154(b) by 0 days.

(21) Appl. No.: 10/234,481

(22) Filed: Sep. 5, 2002

(51) Int. Cl.[7] ..... G04B 19/06; G04B 47/00
(52) U.S. Cl. ..... 368/230; 368/10
(58) Field of Search ..... 368/230, 10

(56) References Cited

U.S. PATENT DOCUMENTS 4,472,065 A * 9/1984 Goodman ..... 368/71
5,559,761 A * 9/1996 Frenkel et al. ..... 368/69

* cited by examiner

*Primary Examiner*—David Martin
*Assistant Examiner*—Michael L. Lindinger
(74) *Attorney, Agent, or Firm*—Bacon & Thomas, PLLC

(57) ABSTRACT

A timepiece with time-display and skin-stimulation control circuit means is disclosed. The timepiece comprises a casing, a glass face disposed on the casing, a set of buttons provided on one end of the casing, two first contact elements bilaterally disposed at a top of the casting and detachably mounted on top of the casing, a circuit board comprising a 7-segment display and a LCD diposed inside the casing. The circuit board is electrical connected to the first contact element. A back cover comprising two openings covers a bottom side of the casing. An insulation plate comprising two bilateral protruded contact elements is detachably a bottom of the back cover. The circuit board is electrically connected with the first contact elements and the bilateral contact elements to sent out a pulse signal.

16 Claims, 7 Drawing Sheets

TIMEPIECE WITH TIME-DISPLAY AND SKIN-STIMULATION CONTROL CIRCUIT MEANS

BACKGROUND OF THE INVENTION

1. Filed of the Invention

The present invention relates to a timepiece, and more particularly to a timepiece with time-display and skin stimulation control circuit means, which outputs long and short pulse signals to the user's skin to report the time under a muted mode and also massage a sore part of the body to provide relief from sore or pain.

2. Description of the Related Art

Regular electronic wrist watches commonly use a voice circuit to report the time or to give an alarm signal. Another prior art timepiece use a single vibration signal to report time. However, conventional electronic wrist watch with voice or single vibration circuit means to report time is not useful to a person who cannot see and hear.

Nowadays driving car is an essential transportation means of our daily life but after driving a car for sometime, the back and the neck of the driver will get fatigue. Further, due to the rapid advancement in computer and information technologies, the use internet to retrieve and transmit information by using computers. The information technology network provides great service and convenience to the users and it has become an essential resource for individuals at home and as well as for companies. Consequently information network service providers operators and well as the users work sitting in front of their computer for a long time everyday. Therefore the back and the neck muscles of the operators get fatigue, and the operators feel tired and have to exercise or massage to relax the muscles and the joints of the body to get relief from the pain and uncomfortable feeling. It is proven that a massage at the sore area or the loci of the pain causing area will give great relief. Accordingly a timepiece having a capability of reporting the time in the dark through skin stimulation means and also for massaging the sore area or loci of the pain causing area for providing muscle fatigue relief would be highly desirable.

SUMMARY OF THE INVENTION

Accordingly, in the view of the foregoing, the present inventor makes a detailed study of related art to evaluate and consider, and uses years of accumulated experience in this field, and through several experiments, to create a new timepiece of the present invention. The present invention provides an innovated timepiece having a capability of reporting the time in the dark as well as skin stimulation means for massaging the sore area or loci of the pain causing area providing relief from muscle fatigue.

In order achieve the above objects and other objects of the present invention, a timepiece with time-display and skin-stimulation control circuit means is provided. The timepiece in accordance with the present invention for fastening to the user's wrist comprises a casing, a glass face disposed on the casing, a set of buttons provided on one end of the casing, two first contact elements bilaterally disposed at a top of the casing and detachably mounted on top of the casing, a circuit board of a 7-segment display and a comprises LCD disposed inside the casing. The circuit board is electrical connected to the metal contact element. The positions of the LCD and 7-segment display are disposed right under glass face. Two protruded bottom spring rods are extended from a bottom surface of the circuit board and the protruded bottom spring rods are disposed between first contact elements and second contact elements electrically connecting the first contact elements with the second contact elements. A battery is disposed under the circuit board. A back cover comprising two openings covers a bottom side of the casing, wherein each second contact elements are partially inserted from the top into each of the opening. An insulation plate comprising two bilateral protruded contact elements is disposed at a bottom of the back cover, wherein each of the projected contact elements comprises a projected fitting element and wherein each projected fitting element comprises a fixing aperture. The insulation plate is mounted onto a bottom of the back cover by engaging the fitting elements of the insulation plate into the openings of the back cover and electrically connected with the second metal contact elements. When a user wears the wristwatch, the two protruded bilateral contact elements will come in contact with a skin of the user's wrist. Thus this arrangement would allow transmission of electrical pulses to stimulate the skin of the user.

According to one aspect of the present invention the back bottom surface of the insulation plate can be made of soft insulation material and the two protruded bilateral contact elements can be made of soft conductive rubber material for the comfort of the user.

According to another aspect of the present invention the bottom provided on one side of the casing is for time setting and adjustment controls.

According to another aspect of the present invention, the circuit board further comprises a control circuit assembly for time displaying and skin-stimulation. The control circuit assembly comprises an input circuit, an IC chip, a display control circuit, a skin-stimulation control circuit, an output circuit and a low electric potential detection circuit. The IC chip is connected to input circuit, the display control circuit, the skin-stimulation control circuit, the output circuit and the low electric potential detection circuit through contact elements. The input circuit receives the battery power supply from the battery. The display control circuit and the skin-stimulation control circuit are respectively connected to the IC chip. The IC chip is for timing and displaying the time on the LCD and the 7-segement display. The display control circuit to transmit the pulse signal to report the time to the user. The IC chip is designed for receiving a contact signal, a preset time signal or a signal from triggering the button.

According to another aspect of the present invention, when the IC chip receives a contact signal, a preset time signal or a signal from triggering the button, the IC chip will drive the skin-stimulation control circuit to generate an ON/OFF pulse signal in response to the contact signal, the preset time reaching signal or the signal from triggering the button, to the output circuit, causing the output circuit in conjunction with the first metal contact elements, the protruded bilateral contact elements and the body of the user, to form an intermittently electrical conductive loop on the user's skin.

According to another aspect of the present invention, the pulse signal from the IC chip includes a long pulse signal, for example hour pulse, and a short pulse signal, for example a minute pulse signal.

According to another aspect of the present invention, the first metal contact elements and the protruded contact elements are in close contact with the skin of the user's body, and the IC chip drives the skin-stimulation control circuit to provide a pulse signal through the skin of the user's body via the first metal contact elements and the protruded bilateral contact elements in response to the contact signal, the preset time reaching signal or the signal from triggering the button.

According to another aspect of the present invention, the wristwatch of the present invention can also be used for massaging sore parts of body by contacting the first metal contact elements or the protruded bilateral contact elements against the sore part of user's body and trigger the button to generate the pulse signals for stimulating the skin on the sore part of the user's body.

According to another aspect of the present invention, the low electric potential detection circuit is for detecting the power level of battery, for example, when the power of the battery is insufficient, the low electric potential detection circuit will output a signal to the IC chip and the IC chip will output a power insufficient signal to the LCD through the display control circuit for reporting the user.

According to another aspect of the present invention, the timepiece of the present invention allows to set an alarm using the button for time report at the preset time. Since the time is reported through skin-stimulation means, therefore the user can know the time even in the dark and the timepiece can be very useful for both blind and deaf persons.

DESCRIPTION OF THE PREFERRED EMBODIMENTS

Figure 1:
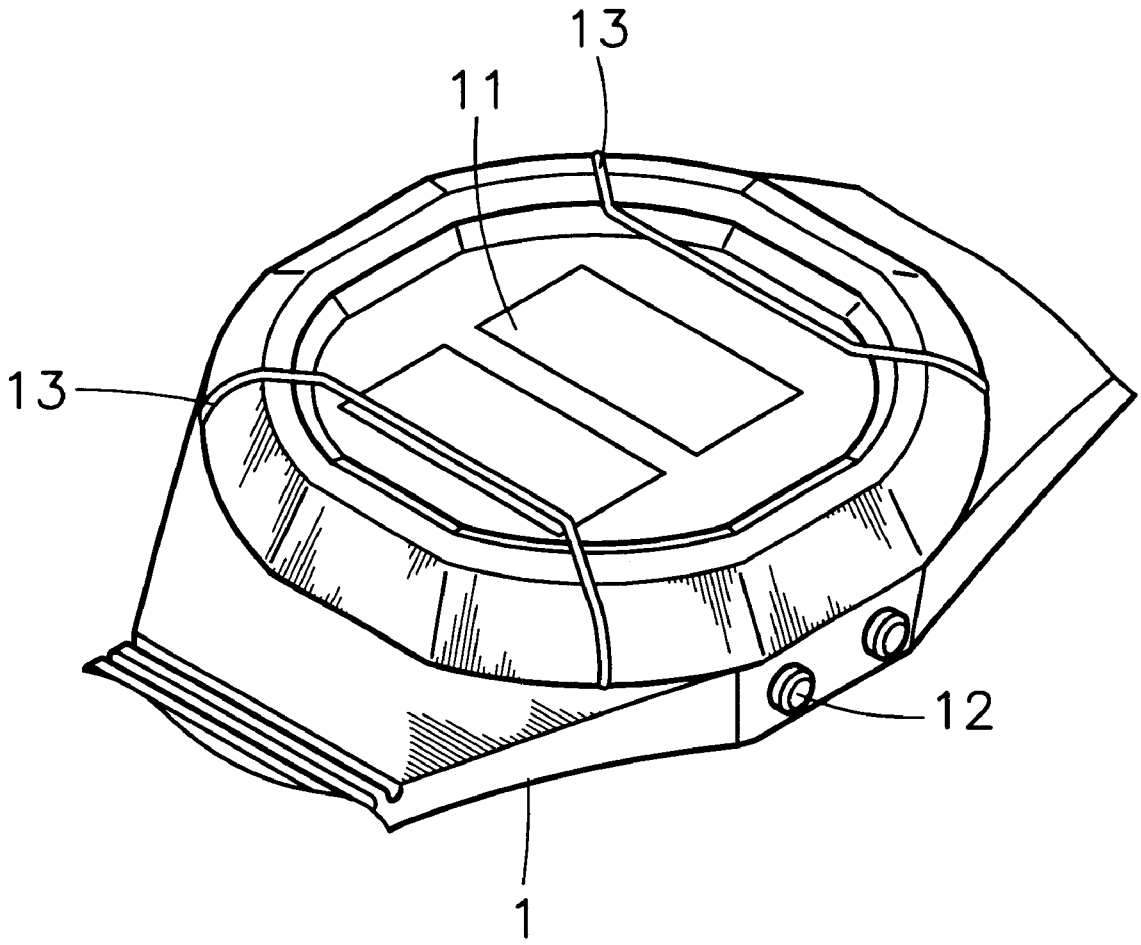
FIG. 1 is an elevational view of a timepiece constructed according to the present invention.

Reference will be made in detail to the preferred embodiments of the invention, examples of which are illustrated in the accompanying drawings. Wherever possible, the same reference numbers are used in the drawings and the description to refer to the same or like parts.

Figure 2:
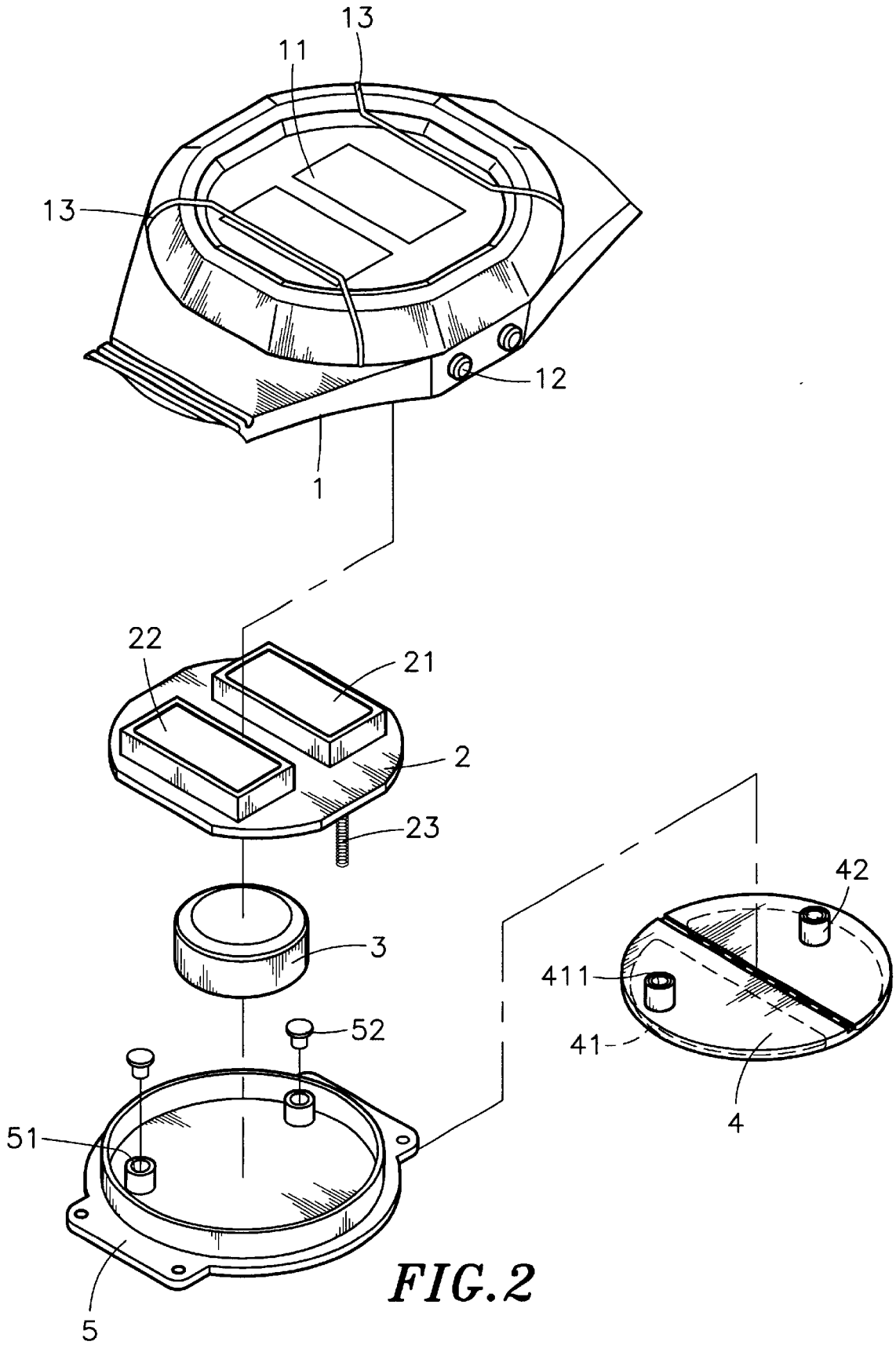
FIG. 2 is an exploded view of the timepiece shown in FIG. 1.
Figure 3:
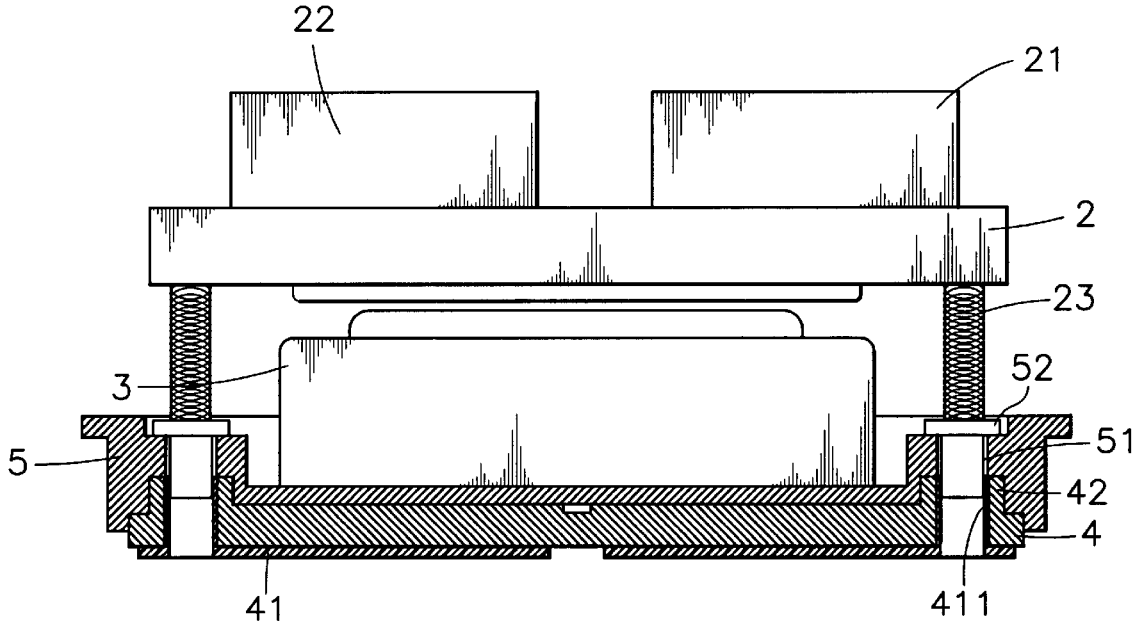
FIG. 3 is a side view in an enlarged scale of a part of the present invention.
Figure 4:
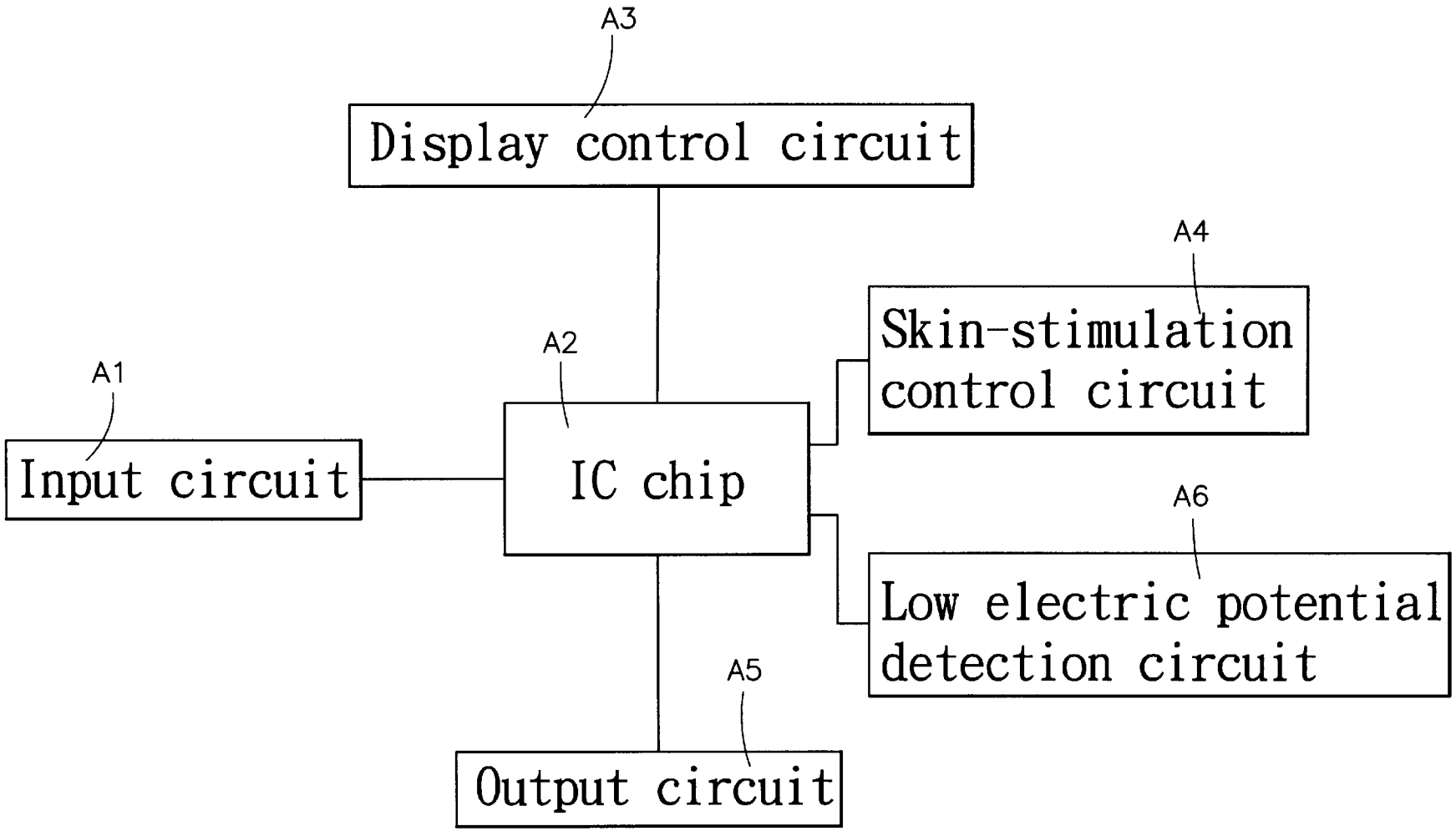
FIG. 4 is a system block diagram of the time-display and skin stimulation control circuit assembly according to the present invention.
Figure 5:
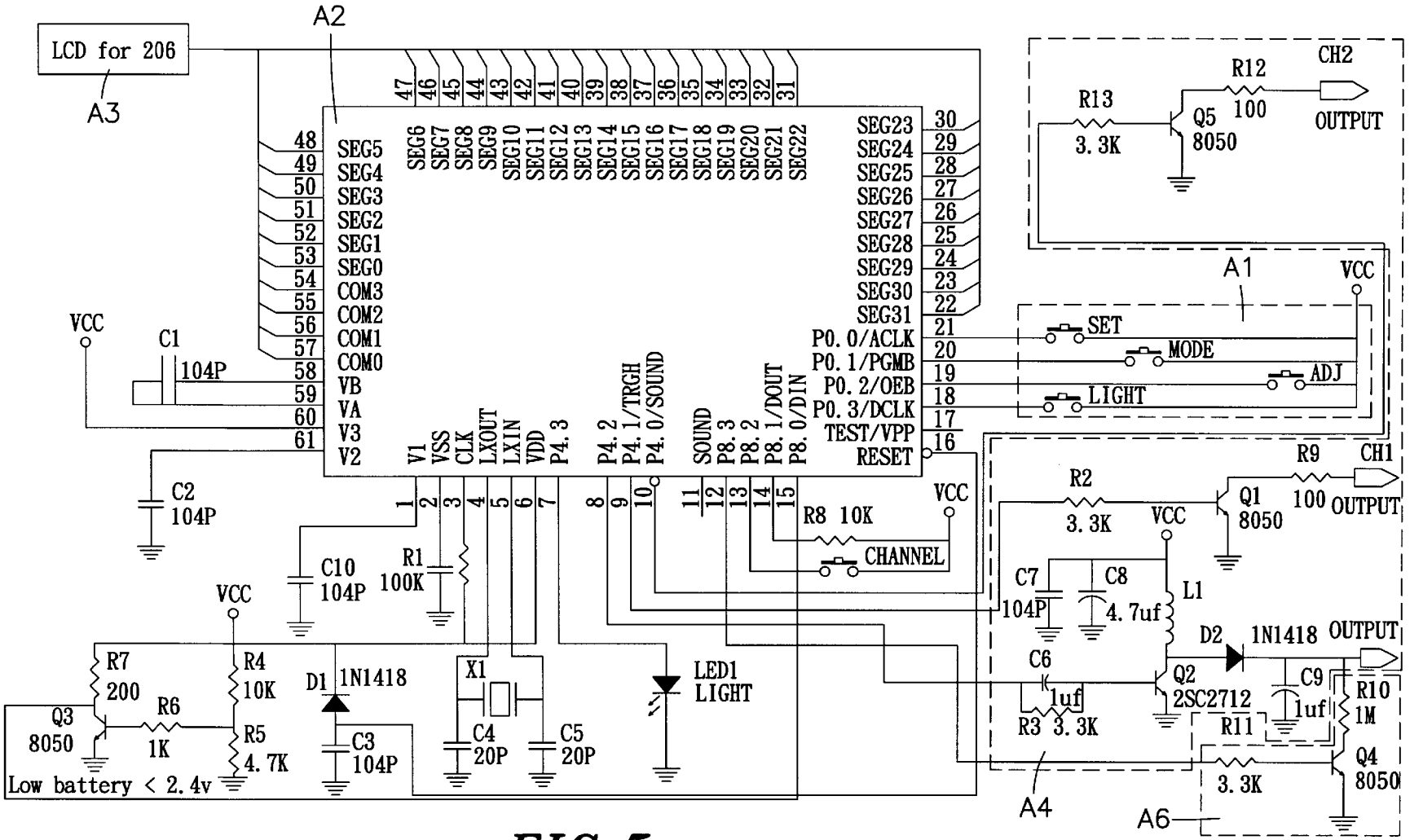
FIG. 5 is a circuit block diagram of the time-display and skin stimulation control circuit assembly according to the present invention.

Referring to FIGS. 1, 2 and 3, the timepiece in accordance with the present invention for fastening to the user's wrist comprises a casing 1, a glass face 11 disposed on the casing 1, a set of buttons 12 provided on one end of the casing 1, two first contact elements 13 bilaterally disposed at a top of the casing 1 and detachably mounted on top of the casing 1, a circuit board 2 comprising a 7-segment display 22 and a LCD 21 disposed inside the casing 1. The circuit board 2 is electrical connected to the first contact element 13. The positions of the LCD 21 and 7-segment display 22 are disposed right under glass face 11. Two protruded bottom spring rods 23 are extended from a bottom surface of the circuit board 2 and the protruded bottom spring rods 23 are disposed between first contact elements 13 and second contact elements 52 electrically connecting the first contact elements 13 with the second contact elements 52. The material of the first contact elements 13 and the second contact elements 52 comprises but not limited to a metal or a conductive rubber. A battery 3 is disposed under the circuit board 2. A back cover 5 comprising two openings 51 covers a bottom side of the casing 1, wherein each second contact elements 52 are partially inserted from the top into each of the opening 51. An insulation plate 4 comprising two bilateral protruded contact elements 41 is disposed at a bottom of the back cover 5, wherein each of the protruded contact elements 41 comprises a projected fitting element 42 and wherein each projected fitting element 42 comprises a fixing aperture 411. The insulation plate 4 is mounted onto a bottom of the back cover 5 by engaging the fitting elements 42 of the insulation plate 4 into the openings 51 of the back cover 5 and electrically connected with the second metal contact elements 52. When a user wears the timepiece, the two protruded bilateral contact elements 41 will come in contact with a skin of the user's wrist. Thus this arrangement would allow transmission of electrical pulses to stimulate the skin of the user.

Further, the back bottom surface of the insulation plate 4 can be made of soft insulation material and the two protruded bilateral contact elements 41 can be made of soft conductive rubber material for the comfort of the user.

Figure 7:
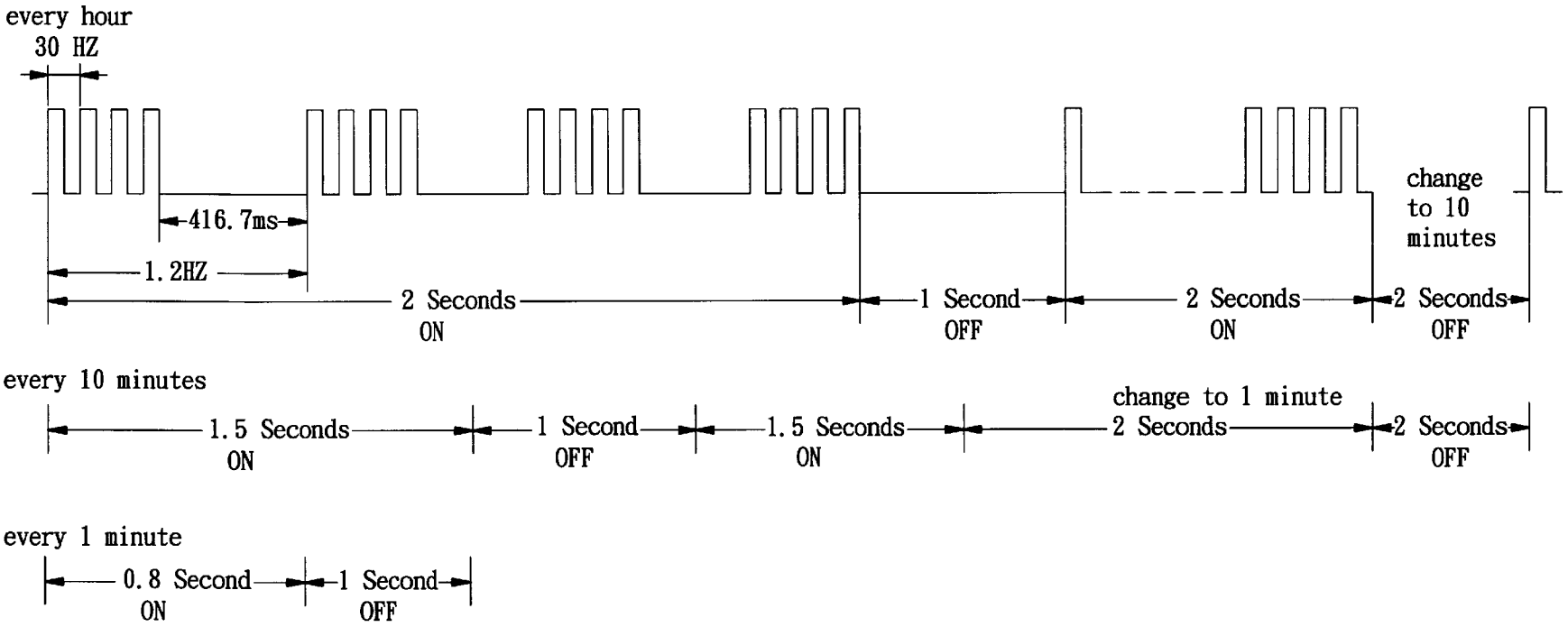
FIG. 7 is a schematic showing duration setting of a pulse signal according to the present invention.

Further more, referring to FIGS. 1, 2, 4 and 5, the bottom 12 provided on one side of the casing 1 is for time setting and adjustment controls. The circuit board 2 further comprises a control circuit assembly A for time displaying and skin-stimulation. The control circuit assembly A comprises an input circuit A1, an IC chip A2 (for example, IC SONIX SDCA101), a display control circuit A3, a skin-stimulation control circuit A4, an output circuit A5 and a low electric potential detection circuit A6. The IC chip A2 is connected to input circuit Al, the display control circuit A3, the skin-stimulation control circuit A4, the output circuit A5 and the low electric potential detection circuit A6 through contact elements. The input circuit Al receives the battery power supply from the battery 3. The display control circuit A3 and the skin-stimulation control circuit A4 are respectively connected to the IC chip A2. The IC chip A2 is for timing and displaying the time on the LCD 21 and the 7-segement display 22. The display control circuit A3 to transmit the pulse signal to report the time to the user. The IC chip A2 is designed for receiving a contact signal, a preset time signal or a signal from triggering the button 12. When the IC chip A2 receives a contact signal, a preset time signal or a signal from triggering the button 12, the IC chip A2 will drive the skin-stimulation control circuit A4 to generate an ON/OFF pulse signal (such as FIG. 7 shows) in response to the contact signal, the preset time reaching signal or the signal from triggering the button 12 to the output circuit A5, causing the output circuit A5 in conjunction with the first contact elements 13, the protruded bilateral contact elements 41 and the body of the user, to form an intermittently electrical conductive loop on the user's skin. The pulse signal from the IC chip A2 includes a long pulse signal, for example hour pulse, and a short pulse signal, for example a minute pulse signal. Thus these pulse signals would clearly define the hours and minutes to report time in both hours and minutes. During operation, the first contact elements 13 and the protruded contact elements 41 are in close contact with the skin of the user's body, and the IC chip A2 drives the skin-stimulation control circuit A4 to provide a pulse signal through the skin of the user's body via the first contact elements 13 and the protruded bilateral contact elements 41 in response to the contact signal, the preset time reaching signal or the signal from triggering the button 12.

Further, the wristwatch of the present invention can also be used for massaging sore parts of body by contacting the first metal contact elements 13 or the protruded bilateral contact elements 41 against the sore part of user's body and trigger the button 12 to generate the pulse signals for stimulating the skin on the sore part of the user's body.

The low electric potential detection circuit A6 is for detecting the power level of battery 3, for example, when the power of the battery 3 is insufficient, the low electric potential detection circuit A6 will output a signal to the IC chip A2, and the IC chip A2 will output a power insufficient signal to the LCD 21 through the display control circuit A3 for reporting the user.

Figure 6:
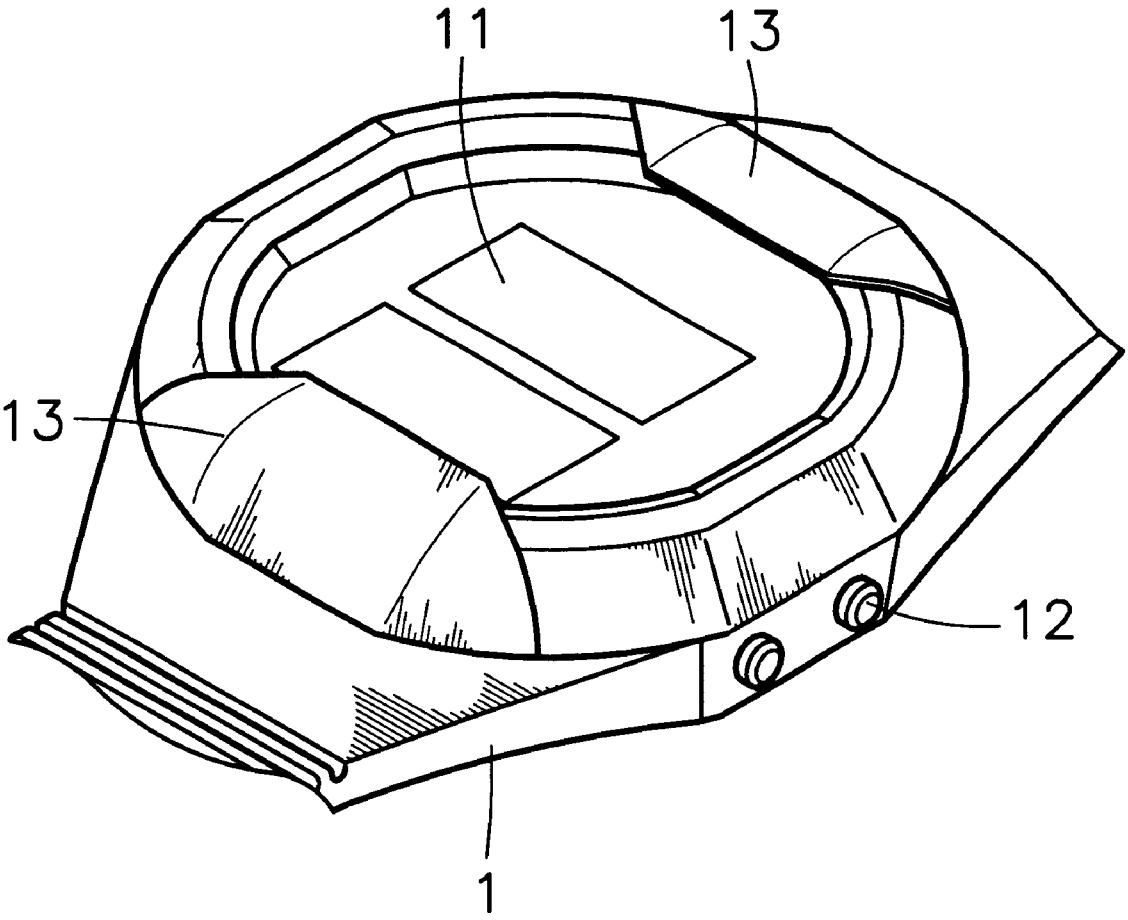
FIG. 6 is an elevational view of an alternate form of the present invention.

Referring to FIG. 6 shows the first metal contact element 13 on the casing 1 of the timepiece can be in a shape of a flat plate according to another embodiment of the present invention.

Further, referring to FIG. 7, is a schematic showing the duration of pulse signals in accordance with the present invention. Taking a 30 Hz pulse signal as an example, a user can set the duration of the pulse signal by using the button 12, for example, by setting 2 seconds for an output pulse signal then a pause for 1 second for 1 hour signal, a 1.5 seconds for an output signal then a pause for 1 second for 10-minute signal, and a 0.8 second for an output signal then a pause 1 second for a 1 minute signal, allowing the user to differentiate the hour from the minute and accordingly understand the time accurately. Further, the user can trigger the button 12 anytime in order to know the time through the skin-stimulation means. The timepiece of the present invention also allows to set an alarm using the button 12 for time report at the preset time. Since the time is reported through skin-stimulation means, therefore the user can know the time even in the dark and the timepiece can be very useful for both blind and deaf persons.

It is to be understood that the above-mentioned 7-segment display 22 of the display control circuit A3 is not essential, the time and function can be displayed by the LCD 21 of display control circuit A3 alone.

In summary, the benefits of the timepiece with time-display and skin-stimulation control circuit means of the present invention are as following:

1. The control circuit through skin-stimulation can clearly define the duration of ON/OFF pulse signal for skin-stimulation on the user's skin through contact elements allowing the user to know the time without actually seeing the display therefore the timepiece of the present invention can be useful for users to know the time in the dark or for persons who are blind and deaf. Further, the user can know the time at any time by triggering the button.
2. The timepiece with time-display and skin-stimulation control circuit means of the present invention allows user to replace the old and contaminated insulation plate and the first contact elements that comes in contact with the skin of the body of the use after a long time usage.
3. The timepiece with time-display and skin-stimulation control circuit means of the present invention can be used to massage the certain sore part of body to get relief from the fatigue muscle.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations which fall within the spirit and scope of the included claims. All matters set forth herein or shown in the accompanying drawings are to be interpreted in an illustrative and non-limiting sense.

What the invention claimed is:

1. A timepiece comprising time setting and adjustment function control buttons installed in a casing thereof, a time-display and skin-stimulation control circuit installed in said casing, a battery installed in said casing and connected to said time-display and skin-stimulation control circuit to provide said time-display and skin-stimulation control circuit with the necessary working voltage, a plurality of main contact elements disposed outside said casing and respectively connected to two opposite terminals of said time-display and skin-stimulation control circuit assembly for contacting the user's skin to output pulse signals to the user's skin from said time-display and skin-stimulation control circuit to stimulate the skin to report time to a user, wherein a longer pulse signal refers to an hour and a shorter pulse signal refers to a minute.

2. The timepiece of claim 1, wherein the timepiece further comprises a low electric potential detection circuit for outputting a low power signal to control circuit in response to a low battery power to a display device.

3. The timepiece of claim 2, wherein the display device is a 7-segment display.

4. The timepiece of claim 1, wherein the time display is a liquid crystal display for the display of function setting.

5. The timepiece of claim 1, wherein the timepiece further comprises a conductive contact over the surface of a glass face disposed over the casing.

6. The timepiece of claim 1, wherein the case comprises a plurality of buttons on a outer side, the circuit board inside the casing is disposed right under the glass face, the battery is disposed between the circuit board and the back cover, and the circuit board is electrically connected with contact elements disposed on the backside of the back cover.

7. The time piece of claim 2, further comprising:

a glass face covering on said casing at a front side over said time-display and skin-stimulation control circuit;

a back cover covered on said casing at a back side, said back cover comprising two openings;

a circuit board mounted inside said casing, a battery cell disposed between the circuit board and the back cover to supply battery power to said circuit board;

two springs rods extending out of a bottom of said circuit board, wherein the two springs rods are electrically connected with metal contact elements that are positioned in the openings of back cover and extending to a bottom of said casing; and said two main contact elements are disposed on two sides of the bottom of said an insulative plate, wherein said insulative plate is detachably engaged into said openings of said back cover at a bottom of the back cover, wherein said main contact elements are protruded upward to make an electrical contact with said metal contact elements.

8. The timepiece of claim 7, wherein said insulation plate disposed on the back side of the casing is made of a soft insulated material.

9. The timepiece of claim 7, wherein the material of said two contact elements comprises a soft conductive rubber.

10. The timepiece of claim 1, wherein said pulse signal output by the skin-stimulation control circuit is a 30 Hz pulse signal, and wherein the user can set the duration of the pulse signal by using the button by setting output 2 seconds then pause for 1 second as 1-hour signal, output 1.5 seconds then pause for 1 second as 10-minute signal, and output 0.8 second then pause 1 second as 1-minute signal, allowing the user know the time according to different duration of pulse signals.

11. A timepiece comprising time setting and adjustment function control buttons installed in said casing, a battery installed in said casing and connected to said time-display and skin stimulation control circuit to provide said time-display and skin-simulation control circuit with the necessary working voltage, a plurality of main contact elements disposed outside said casing and respectively connected to two opposite terminals of said time-display and skin-stimulation control circuit assembly for contacting the user's skin to output pulse signals to the user's skin from said time-display and skin-stimulation control circuit to stimulate the skin to report time to a user, wherein a longer pulse signal refers to an hour and a shorter pulse signal refers to a minute, the timepiece comprising:

a glass face covering on said casing at a front side over said time-display and skin-stimulation control circuit;

a back cover covered on said casing at a back side, said back cover comprising two openings;

a circuit board mounted inside said casing, a battery cell disposed between the circuit board and the back cover to supply battery power to said circuit board;

two springs rods extending out of a bottom of said circuit board, wherein the two springs rods are electrically connected with metal contact elements that are positioned in the openings of back cover and extending to a bottom of said casing; and said two main contact elements are disposed on two sides of the bottom of said an insulative plate, wherein said insulative plate is detachably engaged into said openings of said back cover at a bottom of the back cover, wherein said main contact elements are protruded upward to make an electrical contact with said metal contact elements.

12. The timepiece of claim 11, wherein said contact elements that are positioned in the openings of back cover comprises two contact elements on the upper surface, wherein said two contact elements are electrically connected to said circuit board.

13. The timepiece of claim 11, wherein said timepiece further comprises two contact elements are bilaterally disposed on a top of the glass face, wherein the circuit board disposed inside said casing underneath said glass face electrically connects with said two contact elements.

14. The timepiece of claim 13, wherein the material of said two contact elements is selected from a group consisting of a metal and a conductive rubber.

15. The timepiece of claim 11, wherein said insulation plate detachably attached on the bottom of the back cover is made of a soft insulated material.

16. The timepiece of claim 11, wherein the material of said two contact elements comprises a soft conductive rubber.

* * * * *